US005196107A

United States Patent [19]

Nakaoka et al.

[11] Patent Number: 5,196,107

[45] Date of Patent: Mar. 23, 1993

[54] DISPERSION PLATING METHOD

[75] Inventors: Yasuyuki Nakaoka; Minoru Fujita, both of Amagasaki; Toshikazu Izumo; Tsuyoshi Watanabe, both of Nagasaki, all of Japan

[73] Assignee: Mitsubishi Denki Kabushiki Kaisha, Tokyo, Japan

[21] Appl. No.: 808,774

[22] Filed: Dec. 17, 1991

[30] Foreign Application Priority Data

Dec. 25, 1990 [JP] Japan ..... 2-413050
Feb. 6, 1991 [JP] Japan ..... 3-15119
Apr. 15, 1991 [JP] Japan ..... 3-108264

[51] Int. Cl.[5] ..... C25D 15/00
[52] U.S. Cl. ..... 205/110
[58] Field of Search ..... 205/110

[56] References Cited

PUBLICATIONS

H. Enomoto, "Compisite Plating", published by Nikkan Kogyo on Aug. 30, 1989, p. 108.
"Metal Surface Technique", published by Metal Surface Technique Association in 1982, vol. 33, No. 6, p. 285.
"Manufacturing Method of Electro Plated Tool and Efficiency Thereof", presented in the technical symposium, Partner for Improving Productivity-Diamond.

*Primary Examiner*—T. M. Tufariello
*Attorney, Agent, or Firm*—Burns, Doane, Swecker & Mathis

[57] ABSTRACT

A dispersion plating method in which plating is conducted while plating liquid containing both abrasive grains of a size larger than 10 μm and another grains is brought into contact with the surface of an object to be plated, the latter grains then being removed by washing with water with only abrasive grains being entrapped in a metal matrix. Plating liquid is circulated through a filter of a filtering size smaller than the average grain size of abrasive grains and the abrasive grains are made into a flocculating condition and adhered to the surface of object to be plated. Furthermore, abrasive grains are adhered to the surface of object to be plated in a plating thickness of less than one half of average grain size of abrasive grains.

6 Claims, 18 Drawing Sheets l:FIRST ADHESION
m:SECONO ADHESION
n:THIRD ADHESION

DISPERSION PLATING METHOD

BACKGROUND OF THE INVENTION

1. Field of the Invention

This invention relates to a dispersion plating method which can be used in the production of electro grinder, for example in such a way that abrasive grains of a grain size larger than 10 μm are made into a state of eutectoid in a metal matrix to produce electro grinders.

2. Description of Related Art

FIG. 1 shows a sectional view of electro diamond grinder which was presented in "Metal Surface Technique" published by the Metal Surface Technique Association (Vol. 33, No. 6, P. 285, 1982). This figure shows that diamond abrasive grains 31 are buried inside a metal matrix 33 which is formed on an object to be plated 32, and the diamond abrasive grains are made adhering to the surface so that they may not come out from the position. It has been reported that if diamond abrasive grains 31 are buried inside the metal matrix 33 to a degree of 65% of the diameter, those diamond abrasive grains 31 can be retained in the matrix most efficiently so that they may not come out of the position. It is also reported that it results in the highest level of grinding efficiency.

Usually abrasive grains from a small size of scores of tens μm to larger than 100 μm are used. Abrasive grains of these sizes, however, may not float and accordingly precipitate in plating liquid although it may depend on a level of specific gravity. In order to avoid the precipitation of abrasive grains in the plating liquid and make these grains buried in the metal matrix, abrasive grains must be held in a state of adhering over the surface of an object to be plated until the abrasive grains are buried.

Usually, electro grinders are produced in a two-stage process including the stage of adhesion plating and that of salvage plating. Adhering methods include a sedimentation adhering method and a package adhering method.

FIG. 2 shows a conceptual scheme of an eutectoid method of abrasive grains based on the conventional sedimentation adhering method, which was presented in "Composite Plating" published by a newspaper—The Nikkan Kogyo (Co-author: Hidehiko Enomoto, P. 108, Aug. 30, 1989). In this method, abrasive grains 31 are stirred and dispersed in the plating liquid. As a result, abrasive grains 31 precipitate over the surface of object to be plated 32 which is placed at the bottom of the container of the plating liquid. (See FIG. 2(*a*).) After the above-mentioned process, stirring is stopped and plating follows. Abrasive grains 31 which cover the surface of object to be plated 32 are made in a state of adhering to the surface slightly. (See FIG. 2(*b*).) After dismantling an extra amount of abrasive grains 31 which cover the object to be plated 32, plating is made again over the surface of the object in the plating liquid to increase the thickness of plating in such a condition that abrasive grains 31 are not dispersed in the plating liquid. In this way, abrasive grains 31 which are in an adhering state are buried inside the metal matrix 32. (See FIG. 2(*c*).)

FIG. 3 shows a conceptual scheme of an eutectoid method of abrasive grains based on the conventional package adhering method, which was presented in "Composite Plating" mentioned above. In this method, abrasive grains 31 are placed in a small bag 34 of a predetermined size. (See FIG. 3(*a*).) This bag 34 is put into the plating liquid 35. Then an object to be plated 32 is placed in the bag 34, and the abrasive grains 31 are made into a state of contacting the surface of object to be plated 32 evenly. Then plating is conducted in a minimal level, whereby abrasive grains 31 adhere to the surface. (See FIG. 3(*b*).)

In conventional electro grinder manufacturing method, sedimentation adhering process is most popularly employed. This method holds such a merit that it is possible to make abrasive grains 31 adhere over the surface of object to be plated 32 evenly. In addition, it is especially suitable for providing just one layer of adhering abrasive grains 31.

The existing dispersion plating method is conducted in the way mentioned above. In this method, sedimentation adhering is made mainly by making use of gravity of abrasive grains 31. Accordingly, plating can be made effectively if the surface of object to be plated is flat. However, if the surface of object to be plated is of curving or complicated shape, abrasive grains 31 will adhere only to the flat area. It is accordingly necessary to move the surface of object to be plated gradually in the horizontal direction until it becomes in such a position that abrasive grains 31 fall onto the surface of object to be plated constantly. In addition, plating can be made not only over the area in which abrasive grains 31 adhere to the surface but also the area in which the plating liquid contact the surface. For example, in case of repeatedly conducting dispersion plating, the top level of abrasive grains 31 on a flat object to be plated 32 shown in FIG. 4(*a*) becomes increasingly higher in proportion to the frequency of dispersion plating . As a result, the height of abrasive grains 31 adhering over the surface of object to be plated 32 shown in FIG. 4(*b*) which holds a cylindrical shape may become uneven. This results in such a problem as eccentric dispersion over the object to be plated as a whole. It is, accordingly, necessary that while plating is conducted over the surface areas to which abrasive grains 31 adhere, other areas should be kept masked. As a result, in case of an object to be plated 32 which holds a complicated shape, there exists such a problem that many kinds of meticulous work is required for plating.

In addition, there exist such problems in the conventional dispersion plating method that it is impossible to control the dispersion of abrasive grains evenly, and that since the level of dispersion of abrasive grains is excessively high in general, abrasion tolls manufactured by the conventional method cause dulling easily if certain types of abraded materials are used.

SUMMARY OF THE INVENTION

An object of this invention is to provide a dispersion plating method which makes it possible to conduct plating easily and effectively while grains of a size larger than 10 μm are made adhering over the surface of object to be plated, regardless of the shape of object to be plated.

Another object of this invention is provide a dispersion plating method which makes it possible to disperse grains easily and evenly in a single layer while using a small quantity of large size grains, regardless of the shape and size of the to be plated.

A further object of this invention is to provide a dispersion plating method capable of controlling the level of dispersion of grains easily as well as evenly and saving the cost of expensive abrasive grains.

A still further object of this invention is to provide a dispersion plating method to produce electro grinders which can be applied to grinding tools without causing dulling.

In one dispersion plating method provided by this invention, when those grains are made adhering to an object to be plated, plating liquid is sucked through a filter of a filtering size smaller than average grain size of those grains, and while the grains are adhering to the surface of object to be plated, plating is conducted.

In another dispersion plating method provided by this invention, some of those grains which are put in the area separated by separating member are brought into contact with the surface of object to be plated, and, while the circulating plating liquid is brought into contact with the contact part, the grains are made adhering to the surface of object to be plated in the plating thickness less than one half of average grain size thereof.

In further dispersion method provided by this invention, plating is made in such a condition that, when the first grains of a size larger than 10 μm are made adhering to the surface of object to be plated, both the first grains and another type of grains called the second grains are mixed and brought into contact with the surface of object to be plated. After plating, the second grains are removed and only the first grains are entrapped into the metal matrix.

The above and further objects and features of the invention will more fully be apparent from the following detailed description with accompanying drawings.

DESCRIPTION OF THE PREFERRED EMBODIMENTS

Figure 1:
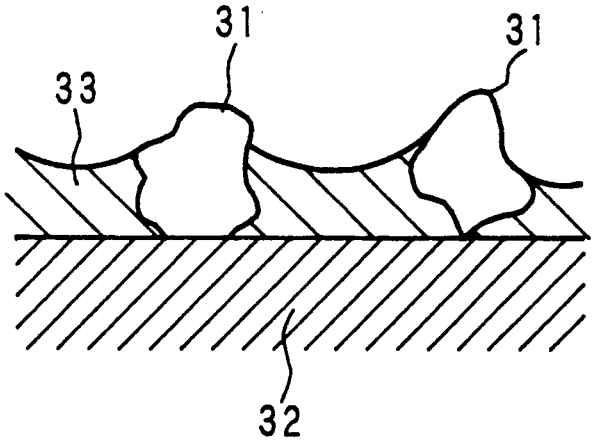
Fig. 1 Prior Art
FIG. 1 is a sectional view of a dispersion plating coat of conventional electro diamond grinder.
Figure 2A:
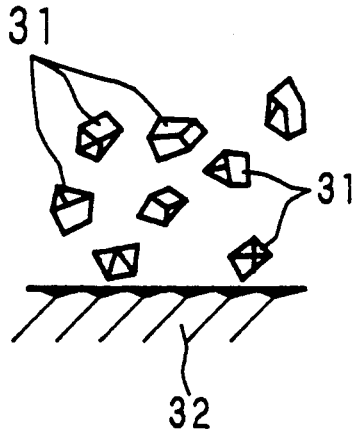
Fig. 2(a) Prior Art
FIG. 2 is a conceptual view of conventional dispersion plating method based on sedimentation adhering process.
Figure 2B:
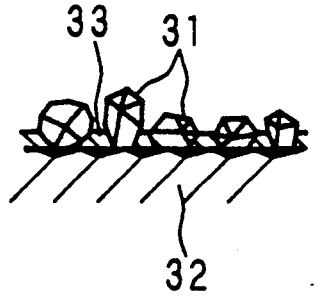
Fig. 2(b) Prior Art
Figure 2C:
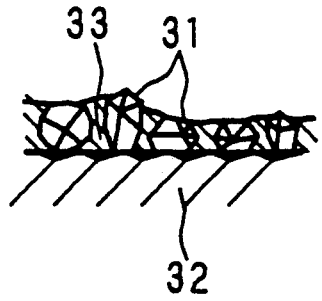
Fig. 2(c) Prior Art
Figure 3A:
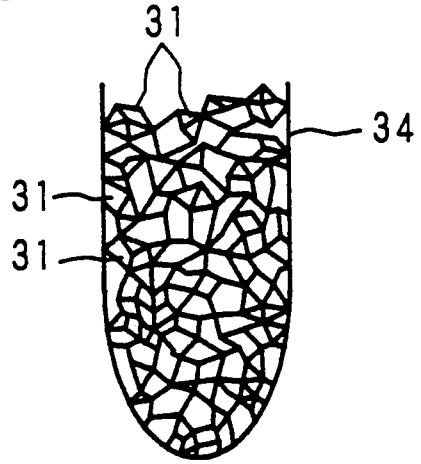
Fig. 3(a) Prior Art
FIG. 3 is a conceptual view of conventional dispersion plating method based on package adhering process.
Figure 3B:
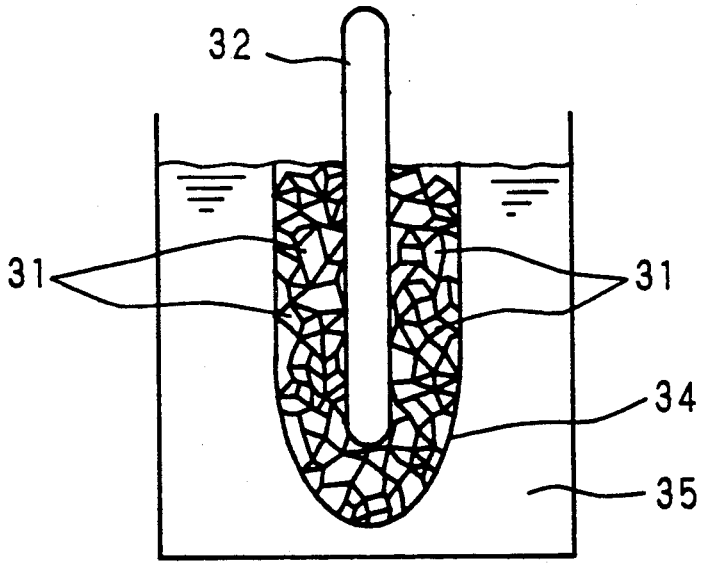
Fig. 3(b) Prior Art
Figure 4A:
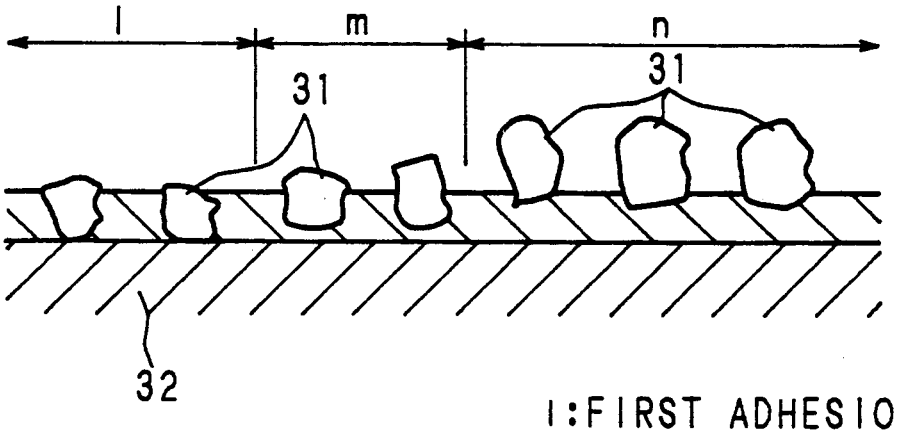
Fig. 4(a) Prior Art
FIG. 4 is a sectional view which indicates defects of conventional dispersion plating method based on sedimentation adhering process.
Figure 4B:
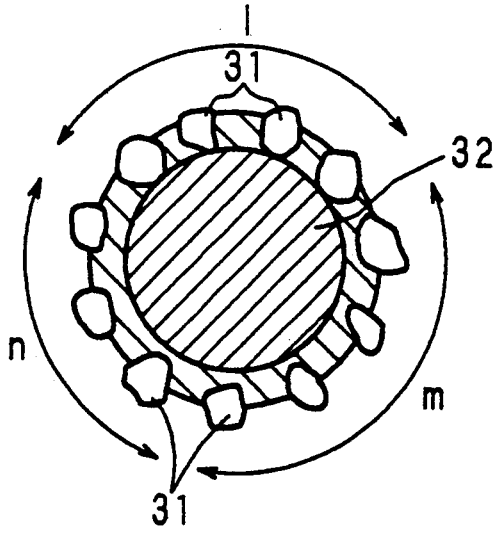
Fig. 4(b) Prior Art

Description is made below about the preferred embodiments of this invention referring to the drawings.

FIRST EMBODIMENT

Figure 5:
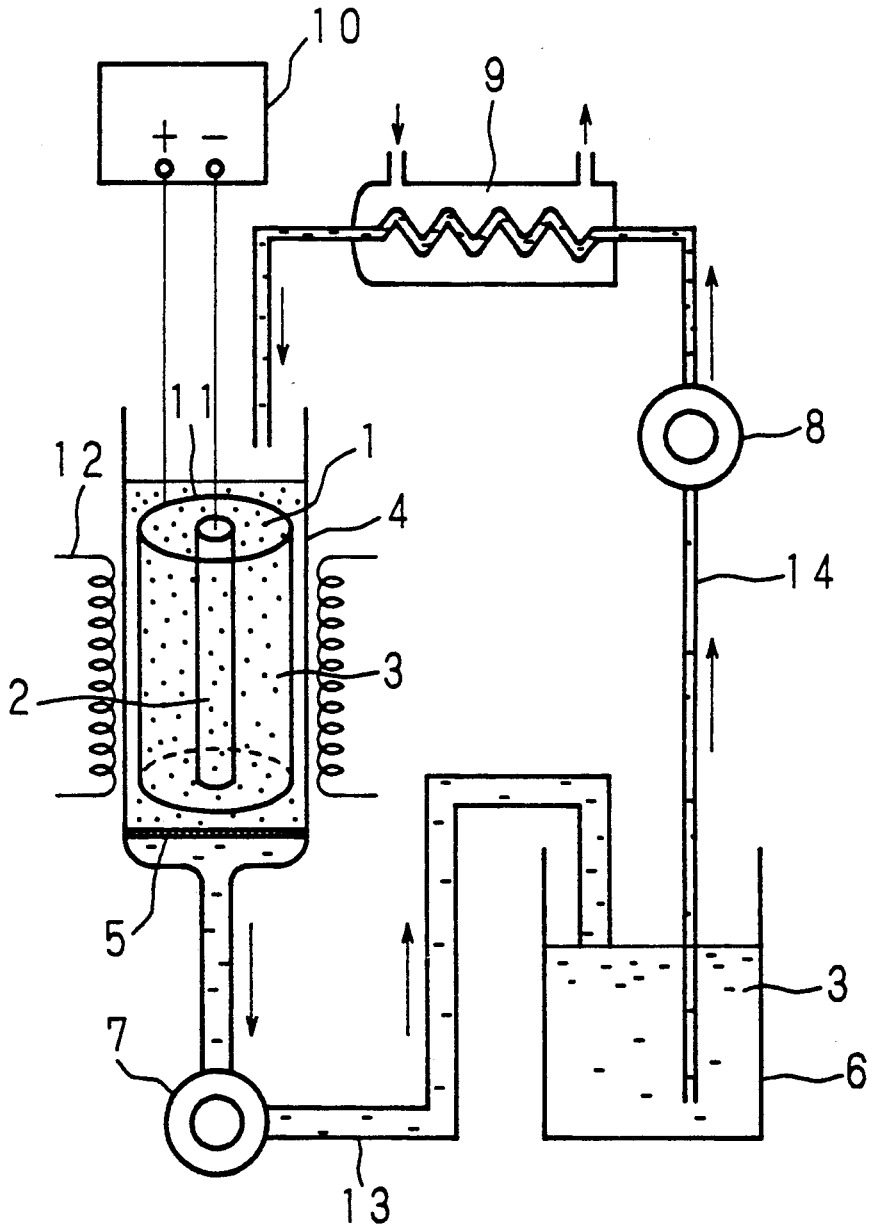
FIG. 5 is a structural view of a whole plating unit to conduct a first embodiment of this invention.
Figure 6:
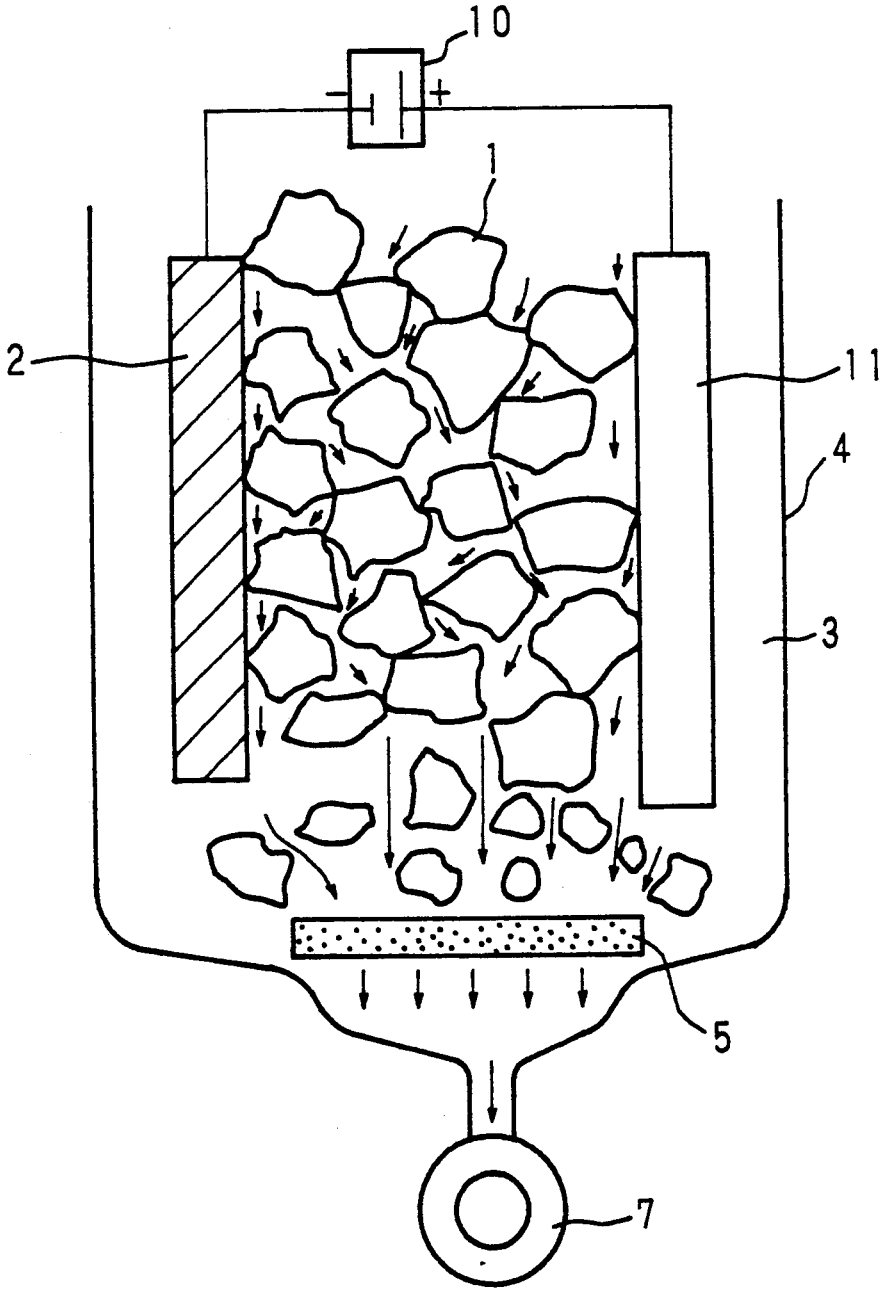
FIG. 6 is a structural view of a main part of the plating unit presented in FIG. 5.

In FIGS. 5 and 6 which show the unit for conducting a first embodiment of this invention, reference numeral 4 shows a cylindrical plating tank made of resin or glass which accommodates a cylindrical object to be plated 2, abrasive grains 1 and plating liquid 3. Inside the plating tank 4, an anode 11 is installed which is connected to the positive side of a power source 10. The negative side of the power source 10 is connected to the object to be plated 2. A heater 12 is installed around the plating tank 4. At the bottom of the plating tank 4, a filter 5 of a filtering size less than the average grain size of abrasive grains 1 is installed in order to prevent the abrasive grains 1 from flowing out. In addition to a glass filter which is popularly used, such filter as a membrane filter and a metal filter which do not affect the flow of plating liquid 3 and furthermore hold a sufficient capacity to retain abrasive grains 1 may be used for filter 5. The filtering size of filter 5 should be such a value that the filter can retain abrasive grains 1 sufficiently and the plating liquid 3 will flow smoothly. Although the filtering size of filter 5 is not limited here, it is recommended to choose a filtering size of approximately one half of average grain size of abrasive grains 1. More specifically, a glass filter with a filtering size of approximately 50 μm is used since the grain size of abrasive grains 1 exceeds 100 μm.

A suction pipe 13 which leads to the tank 6 containing plating liquid 3 is connected to the bottom of the plating tank 4, and a suction pump 7 is installed in the middle section of the suction pipe 13. A supply pipe 14 which supplies plating liquid 3 runs through the tank 6. In the middle section of the supply pipe 14, a supply pump 8 and a heat exchanger 9 are installed. The plating liquid 3 is sucked by the suction pump 7 through the filter 5 and then delivered to the tank 6 through the suction pipe 13. In this stage, the plating liquid 3 is supplied by the supply pump 8 from the tank 6 through the supply pipe 14 in order to maintain the amount of plating liquid 3 inside the plating tank 4 at a constant level. In other words, the supply speed of plating liquid 3 is so adjusted to be equal to the suction speed. The supply speed of plating liquid 3 is specifically set at 10 cc/min. Furthermore, the plating liquid 3 is heated to an appropriate level of temperature after passing the heat exchanger 9 prior to supply to the plating tank 4. In the plating tank 4, the temperature of the plating liquid 3 is maintained at an appropriate level by the heater 12. Specifically, the temperature of plating liquid 3 is maintained at 55° C.

Used as plating liquid 3 is watt type PH4 nickel plating liquid consisting of 240 g/liter of nickel sulfate, 45 g/liter of nickel chloride, 30 g/liter of boric acid and 0.5 g/liter of sodium lauryl sulfate. The type of liquid to be used as plating liquid 3 is not limited to the example mentioned in the above, and such nickel plating liquids as nickel sulfamic acid plating liquid may be used.

Description of the mechanism of plating is given below.

First of all, plating liquid 3 is supplied in such an amount that it will not overflow the plating tank 4 which contains abrasive grains 1, and a stirring bar (not shown in the figure) is inserted into the plating tank 4. The plating liquid 3 is stirred with the stirring bar so that cohesion of the abrasive grains 1 is reduced. Then the stirring bar is taken out of the plating tank 4. The object to be plated 2 which has received strike nickel plating treatment in order to obtain a certain level of adhesion to the dispersion plating coat, is dipped into the plating liquid 3 which hold a reduced cohesion level of abrasive grains 1 after stirring. Then, the object to be plated 2 is rotated or moved up and down several times. This will result in separation of bubbles from the surface of object to be plated 2. When both the suction pump 7 and the supply pump 8 are operated and the plating liquid 3 is sucked by the suction pump 7, those abrasive grains 1 inside the plating tank 4 will begin to be deposited at the bottom of the plating tank 4 and the abrasive grains 1 will flocculate. As a result, the abrasive grains 1 will be pushed to the surface of the object to be plated 2 and made in a state of adhering. Plating will be started when both suction and supply speeds of the plating liquid 3 reach a constant level and the plating liquid 3 begins to flow smoothly over the surface of object to be plated 2. The condition of plating is not to be limited here, but in this experiment, plating is continued for 60 minutes at 0.5 A/dm$^2$.

After the above mentioned process, the plating liquid 3 is slightly made flowing in a reverse direction by the suction pump 7 in order to reduce cohesion of abrasive grains 1. Then the object to be plated 2 is taken out of the plating tank 4. The object to be plated 2 is then washed by water and cleaned by ultrasonic cleaning for one minute to remove an extra amount of abrasive grains 1. Then salvage nickel plating is made in another plating tank which does not contain abrasive grains 1 until the plating thickness reaches approximately 60% of the average size of abrasive grains 1, and the abrasive grains 1 are made into a state of adhering being buried completely in the surface of the object to be plated 2.

Description of a modified pattern of the first embodiment of the invention is made below referring to FIG. 7 which shows the conduct state thereof. This modified pattern of the first embodiment holds a purpose of making abrasive grains adhere evenly over uneven surface of object to be plated which holds a cavity or cavities. Reference numeral 2 in the figure shows an object to be plated which holds a cavity 2*a*. Inside the cavity 2*a*, a suction pipe 13 which holds a filter 5 at the bottom is inserted. An anode 11 which surrounds the suction pipe 13 is installed in parallel to the surface of the object to be plated 2 in equal distance. The cavity 2*a* contains both abrasive grains 1 and plating liquid 3. Other parts of the system are made in the same way as those of the preferred embodiment of the invention already mentioned. Accordingly, no description will be made below, except that the identical parts will be given the same numbers as those in the preferred embodiment mentioned in the above.

Description is made below about the plating procedure of the modified pattern of the preferred embodiment.

First of all, abrasive grains 1 are filled in the cavity 2*a* of the object to be plated 2, to which the suction pipe 13 is inserted. The abrasive grains 1 are mixed sufficiently with the plating liquid 3 in advance, so that they fit each other smoothly. The plating liquid 3 is supplied through a supply pipe 14 in such an amount that the plating liquid 3 will not overflow the cavity 2*a*. Then a stirring bar (not shown in the figure) is inserted into the cavity 2*a* and moved along the surface of the object to be plated 2. As a result of this motion, the level of cohesion of abrasion grains 1 is reduced, and bubbles are disconnected from the surface of object to be plated 2. After this motion, the stirring bar is taken out. Then the pumps 7 and 8 start operation and the plating liquid 3 circulates. The abrasive grains 1 gradually begin to be deposited at the bottom of the cavity 2*a* and the flocculation of abrasive grains 1 begins. As a result, the abrasive grains 1 are pushed to the surface of object to be plated 2 and adhered to it. When the speeds of both suction and supply of plating liquid 3 reach a certain level and the plating liquid 3 flows smoothly, plating process is started. Plating is made in the same way as that of the preferred embodiment of the invention mentioned above. Then the same treatment as that of the preferred embodiment of mentioned in the above (removal of an extra amount of abrasive grains 1 and salvage nickel plating) is conducted to bury abrasive grains 1 inside the surface of cavity 2*a* completely and keep them in a state of adhesion.

SECOND EMBODIMENT

Description of a second embodiment of this invention is made below.

Figure 7:
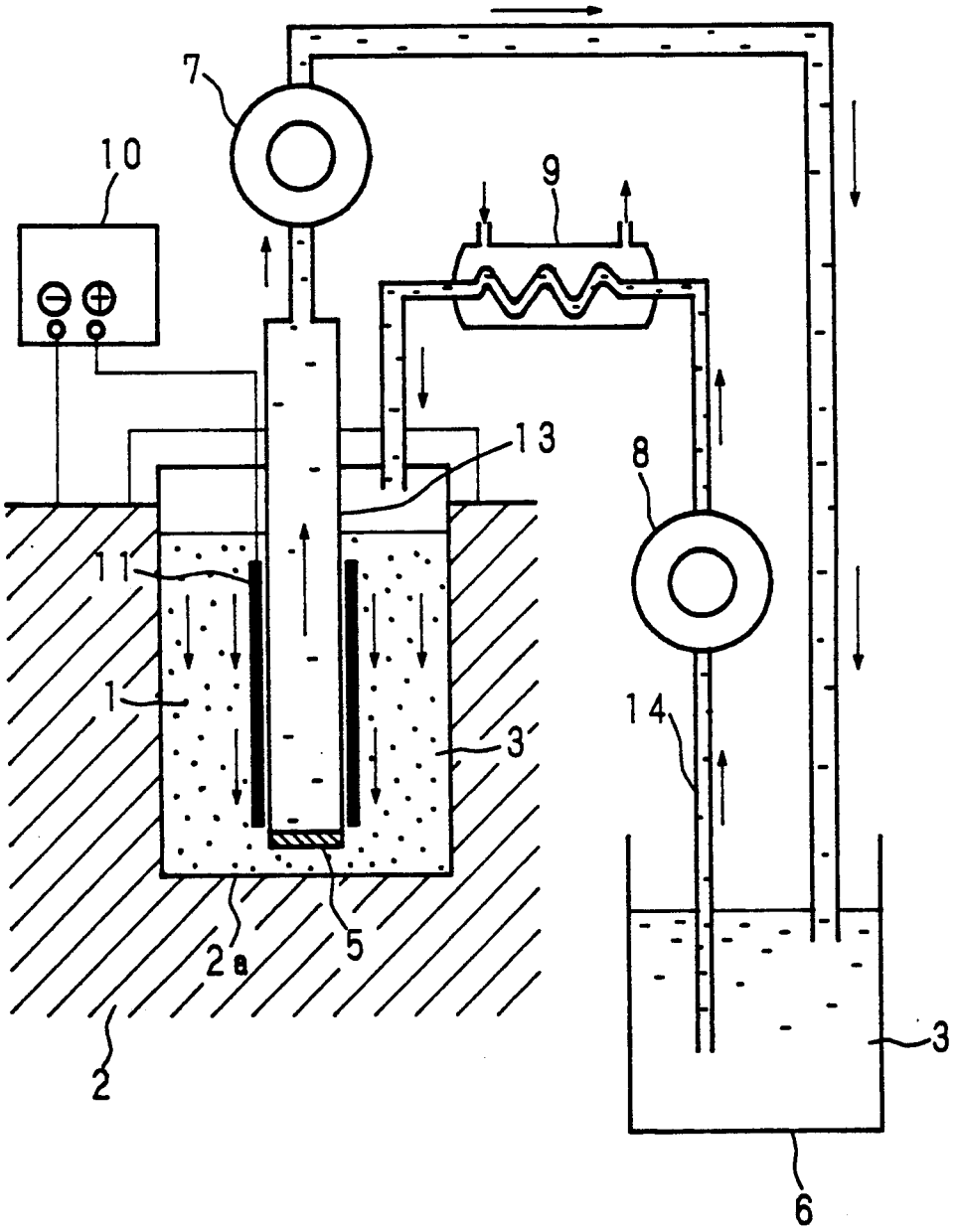
FIG. 7 is a structural view of a whole plating unit to conduct a modified pattern of the first embodiment.
Figure 8:
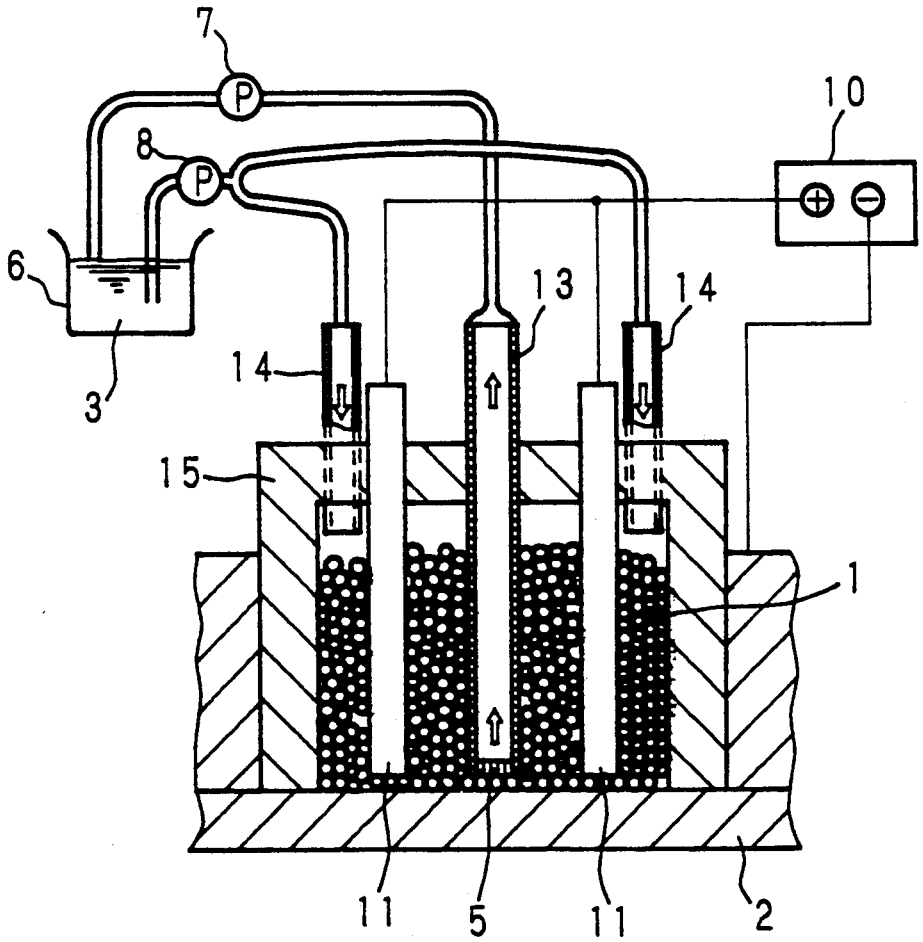
FIG. 8 is a sectional front view of a plating unit to conduct a second embodiment of this invention.
Figure 9:
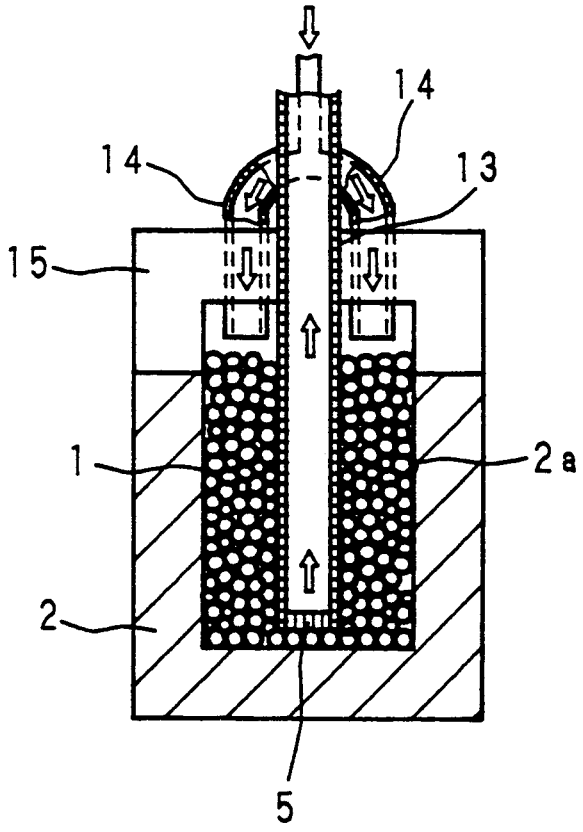
FIG. 9 is a sectional side view of the plating unit presented in FIG. 8.

In FIGS. 8 and 9 which show the unit used for the second embodiment of the invention, those parts which are given the same numbers as those in FIGS. 5 and 7 use the same materials as those in FIGS 5 and 7. In the figure, reference numeral 2 is an object to be plated which holds a continuous chain of cavity 2*a*. Reference numeral 15 is a separating member made of such materials as a silicon rubber board. This separating member 15 separates the cavity 2*a* and accommodates abrasive grains 1 inside the separated area. Both suction pipe 13 and an anode 11 are inserted into the separated area, and one end of supply pipe 14 is placed on top of abrasive grains 1 which are contained in the separated are. Other parts of the unit are same as those in the first embodiment of the invention mentioned in the above. Accordingly, no description is made about these parts here.

Description is made about the procedure of plating in the second embodiment of the invention.

The separating member 15 is inserted into part of the cavity 2*a* of the object to be plated 2, and both abrasive grains 1 and plating liquid 3 are filled in the separated area which is separated by the separating member 15. Abrasive grains 1 and plating liquid 3 are mixed together sufficiently so that they fit each other smoothly. The anode 11 is placed in parallel to the surface of object to be plated 2 in equal distance. Then the same procedure as that for the modified pattern of the first embodiment is conducted to make abrasive grains 1 adhere to the surface of object to be plated 2. When adhesion is made, plating treatment is started.

After the abrasive grains 1 adhere to the surface of object to be plated 2 completely, abrasive grains 1 in the second layer or above which are not adhering to the surface of the object to be plated 2 sufficiently will be washed out by water from the surface. In this embodiment of the invention, abrasive grains 1 are contained inside the separated area at a high level of density, and circulating plating liquid 3 is supplied to the inside of the separated area, so that abrasive grains 1 flocculate being pushed to the surface of object to be plated 2.

Figure 10A:
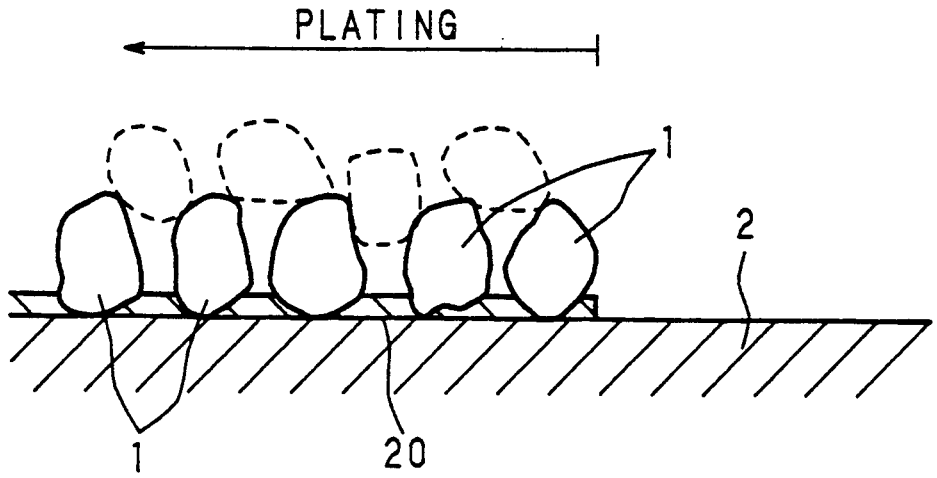
FIG. 10 is an expanded sectional view of dispersion plating coat in the second embodiment.
Figure 10B:
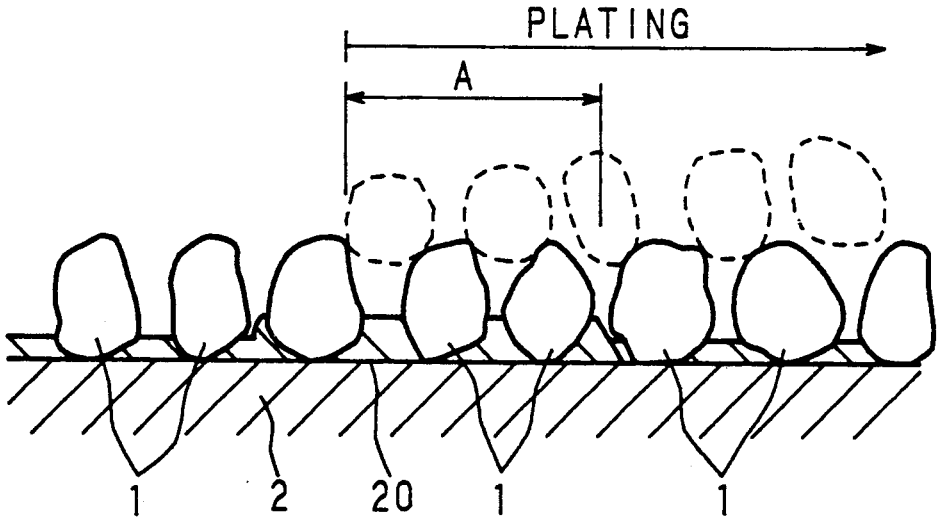

However, since the abrasive grains 1 are made into an adhering state in a thin layer of plating, those abrasive grains 1 in the second layer or above are not to be made into a state of adhering, and only a single layer of those abrasive grains 1 are made into a state of adhering. FIG. 10 shows a dispersion plating coat in such a state. At superposed section A, the thickness of metal plating (metal matrix) 20 becomes twice that of other section. If the plating thickness at superposed section A is set at a value below one half of average grain size of abrasive grains 1, however, it is possible to make adhesion in a single layer at superposed section A.

After the process mentioned in the above, the same treatment as that of the first embodiment of the invention is made, and salvage nickel plating is conducted to make abrasive grains 1 adhere to the surface of object to be plated 2.

In the above preferred embodiment of the invention, the inside of cavity 2*a* is separated by the separating member 15 to conduct plating and superposed section A is set up, so that continuous dispersion plating coat is formed as mentioned in the above. However, it is not always necessary to set up superposed section A. In such a case, it is possible to enlarge the plating thickness for adhesion. If the plating thickness is less than one half of average grain size of abrasive grains 1, it is possible to make adhesion in a single layer without making adhesion of abrasive grains 1, in the second layer or above.

Description is made below about a modified pattern of the second embodiment of the invention.

Figure 11:
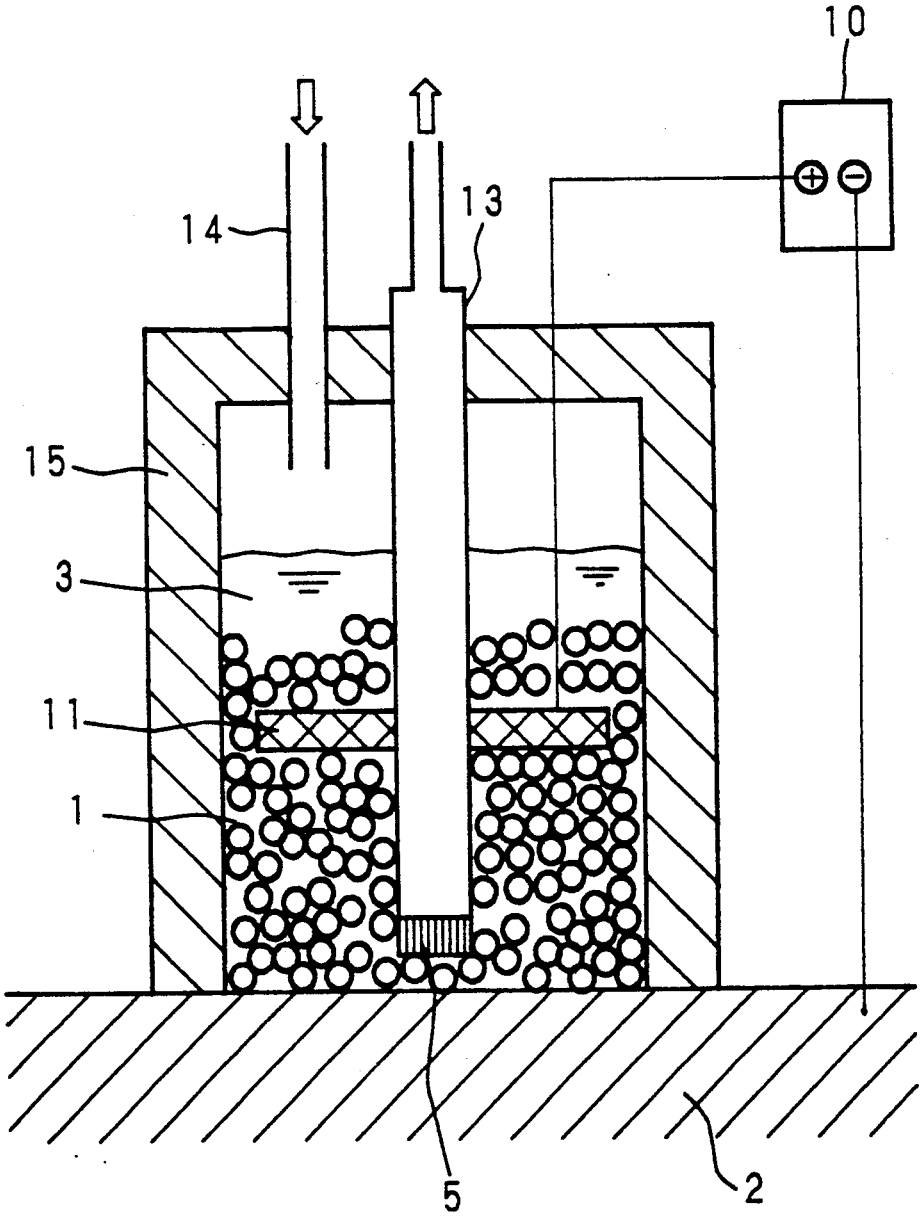
FIG. 11 is a sectional view showing the conduct state of a modified pattern of the second embodiment.

FIG. 11 shows a preferred embodiment of dispersion plating on an object to be plated 2 which holds a flat surface to be plated. When conducting dispersion plating over a wide area in such a case, section to be plated is moved gradually while moving the separating member 15. In this case, if superposed section exists as seen in the preferred embodiment of the invention mentioned above, the plating thickness at superposed section should be less than one half of average grain size of abrasive grains 1. If there exists no superposed sections, the plating thickness upon adhesion may be made less than one half of average grain size of abrasive grains 1. This makes it possible to make adhesion in a single layer.

Figure 12:
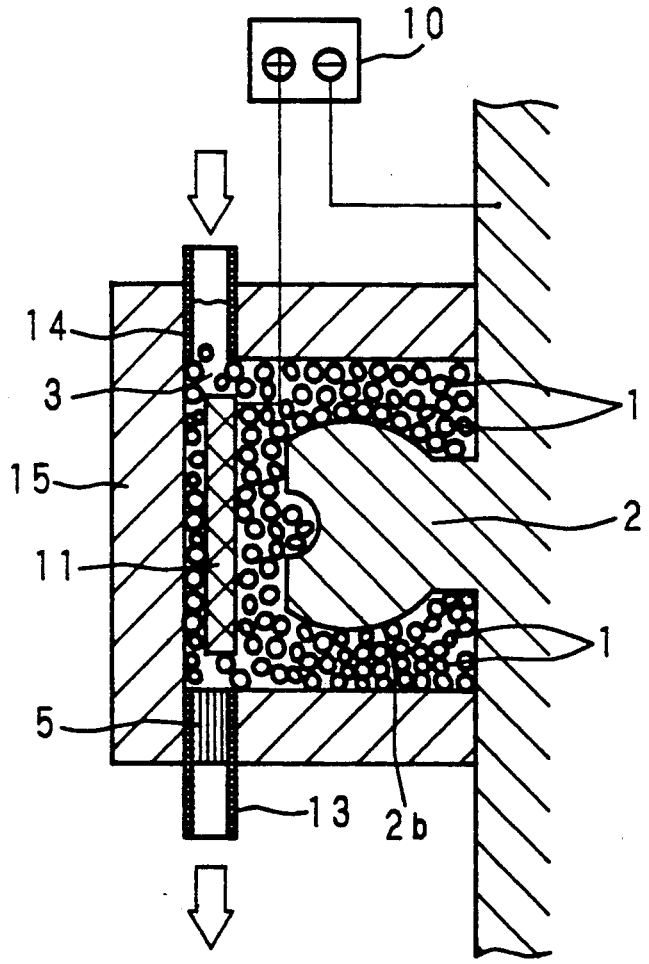
FIG. 12 is a sectional view showing the conduct state of another modified pattern of the second embodiment.

FIG. 12 shows a preferred embodiment of the invention in which dispersion plating is conducted on an object to be plated 2 with such a complicated surface as a curving surface 2*b*. Since abrasive grains 1 are filled in the area separated by the separating member 15, those abrasive grains 1 which come to contact with the curving surface to be plated 2*b* receive circulating flow of plating liquid 3 and are pushed by a considerable force to the curving surface 2*b*. As a result, those abrasive grains will adhere evenly in a single layer over the whole surface at a high level of density.

THIRD EMBODIMENT

Description is made below about a third embodiment of this invention.

Figure 13:
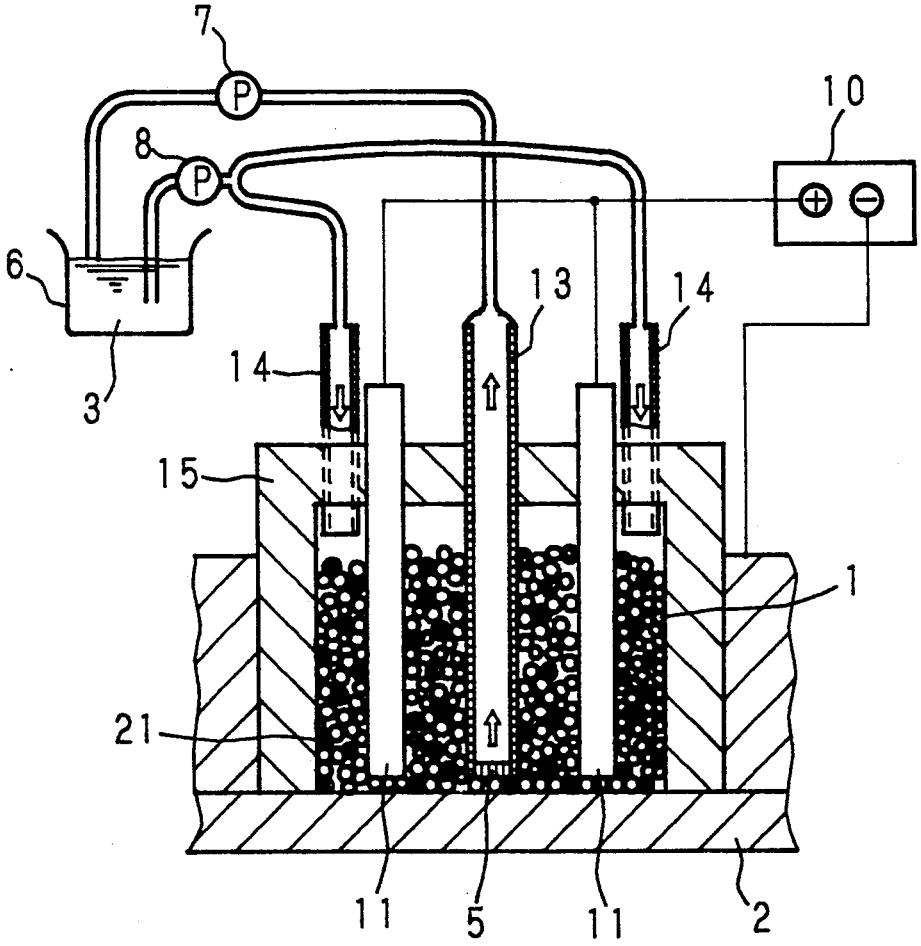
FIG. 13 is a sectional front view of a plating unit to conduct a third embodiment of this invention.
Figure 14:
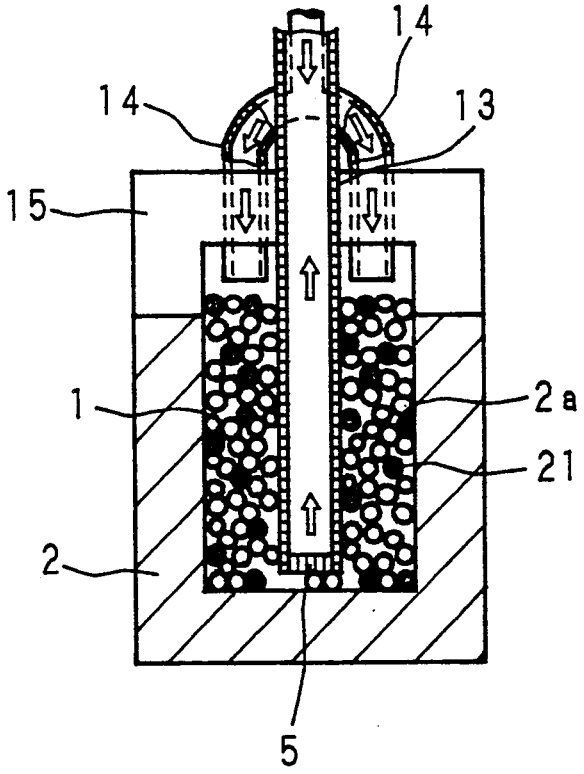
FIG. 14 is a sectional side view of the plating unit presented in FIG. 13, FIGS. 15 and 16 are expanded sectional views of dispersion plating coat presented in the third embodiment.

FIGS. 13 and 14 show a unit which is used to conduct the third embodiment of the invention. In these figures, those parts which are given the same numbers as those in FIGS. 8 and 9 use the same materials as those in FIGS. 8 and 9. In the third embodiment of the invention, abrasive grains 1 which are diamond grains with a diameter of approximately 100 μm and glass bead grains with a diameter of approximately 100 μm are filled in the area separated by the separating member 15. The abrasive grains 1 and glass bead grains 21 are mixed in the ratio of 50% each. The same materials as those in the second embodiment of the invention are used for other parts of the third embodiment of the invention. Accordingly, no description is made here about those parts.

Description is made about the plating process below.

The process of plating in the third embodiment of the invention is essentially same as that of the second embodiment of the invention. In the third embodiment of the invention, as the plating liquid 3 circulates, abrasive grains 1 (diamond grains) and glass bead grains 21 begin to be deposited at the bottom of the cavity 2*a*, and both grains 1 and grains 21 are pushed over the surface of object to be plated 2. In this condition, plating is made and the process of adhering abrasive grains 1 is completed. Those abrasive grains 1 in the second layer or above which are not adhering to the surface sufficiently and those glass bead grains 21 will be removed by washing with water. As a result, only a single layer of abrasive grains 1 are made adhering to the surface of object to be plated 2.

Figure 15A:
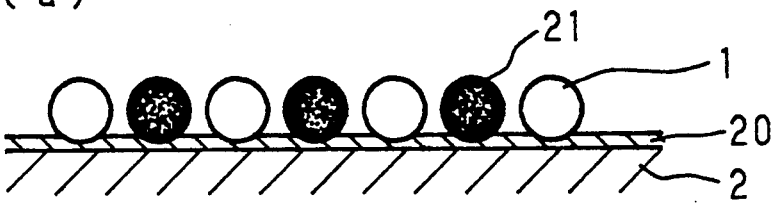
Figure 15B:
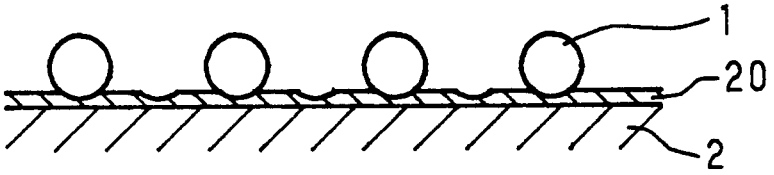
Figure 15C:
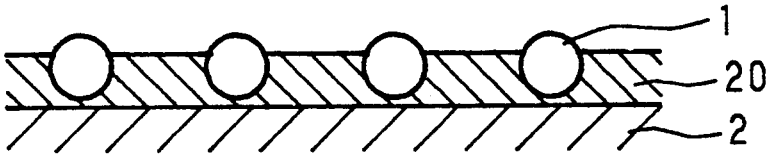

FIG. 15 shows a transition of the state of plating coat of the third embodiment of the invention. Abrasive grains 1 and glass bead grains 21 are pushed onto the surface of object to be plated 2 immediately after the primary plating. (See FIG. 15(*a*) .) when being washed with water, glass bead grains 21 will be easily removed since the thickness of metal plating 20 is thin. (See FIG. 15(*b*) .) Then the secondary plating is conducted to make salvage plating. As a result, the thickness of the metal plating 20 is increased, and a single layer of abrasive grains 1 will firmly adhere to the surface of object to be plated 2. (See FIG. 15(*c*) .)

Figure 16A:
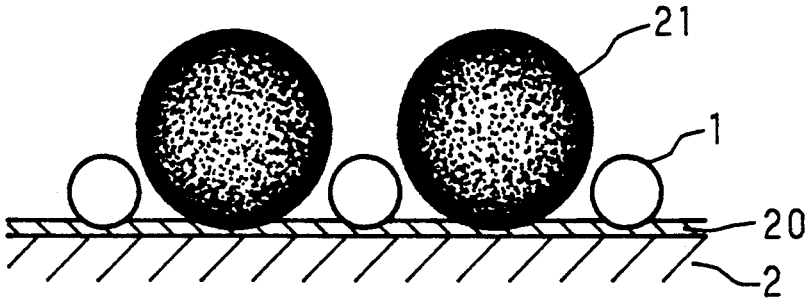
Figure 16B:
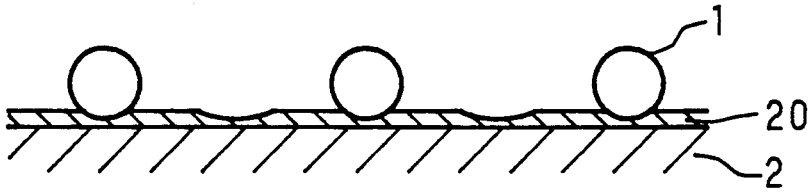
Figure 16C:
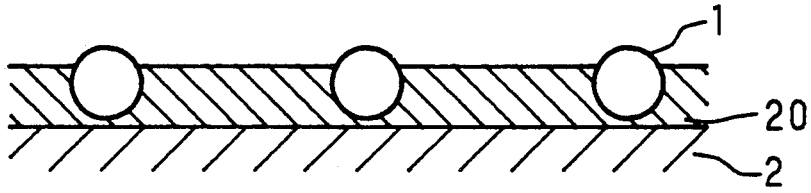

In the above embodiment of the invention, the size of the abrasive grains 1 and that of the glass bead grains are equal. However, glass bead grains 21 of a size smaller or larger than that of abrasive grains 1 can be used. FIG. 16 shows a transition of plating coat in case of using glass bead grains 21 of a size larger than that of abrasive grains 1. Furthermore, glass bead grains 21 should not necessarily be even in size.

In the embodiment of the invention mentioned above, the process of removing glass bead grains 21 is conducted after the primary plating process. It, however, may be conducted after the secondary plating (salvage) process. Furthermore, it is possible to conduct only the primary plating process and omit the secondary plating process. In the embodiment of the invention, abrasive grains 1 and glass bead grains 21 are mixed in the ratio of 50% each. This ratio, however, may be changed. The mixing ratio of these grains 1 and 21 may be determined in a value which suits the level of grain dispersion by considering processing efficiency including such factors as dulling caused by materials to be abraded. In addition, although glass bead grains 21 are used in this embodiment of the invention, hollow glass grains which may be easily crushed or rubber grains which may be easily transformed in elasticity may be used in the process. It is recommended to use those grains which holds a shape of globe. However, any shape of grains may be used if they are made of such a material or materials that can be easily removed.

Description of a modified pattern of the third embodiment of the invention is given below.

Figure 17:
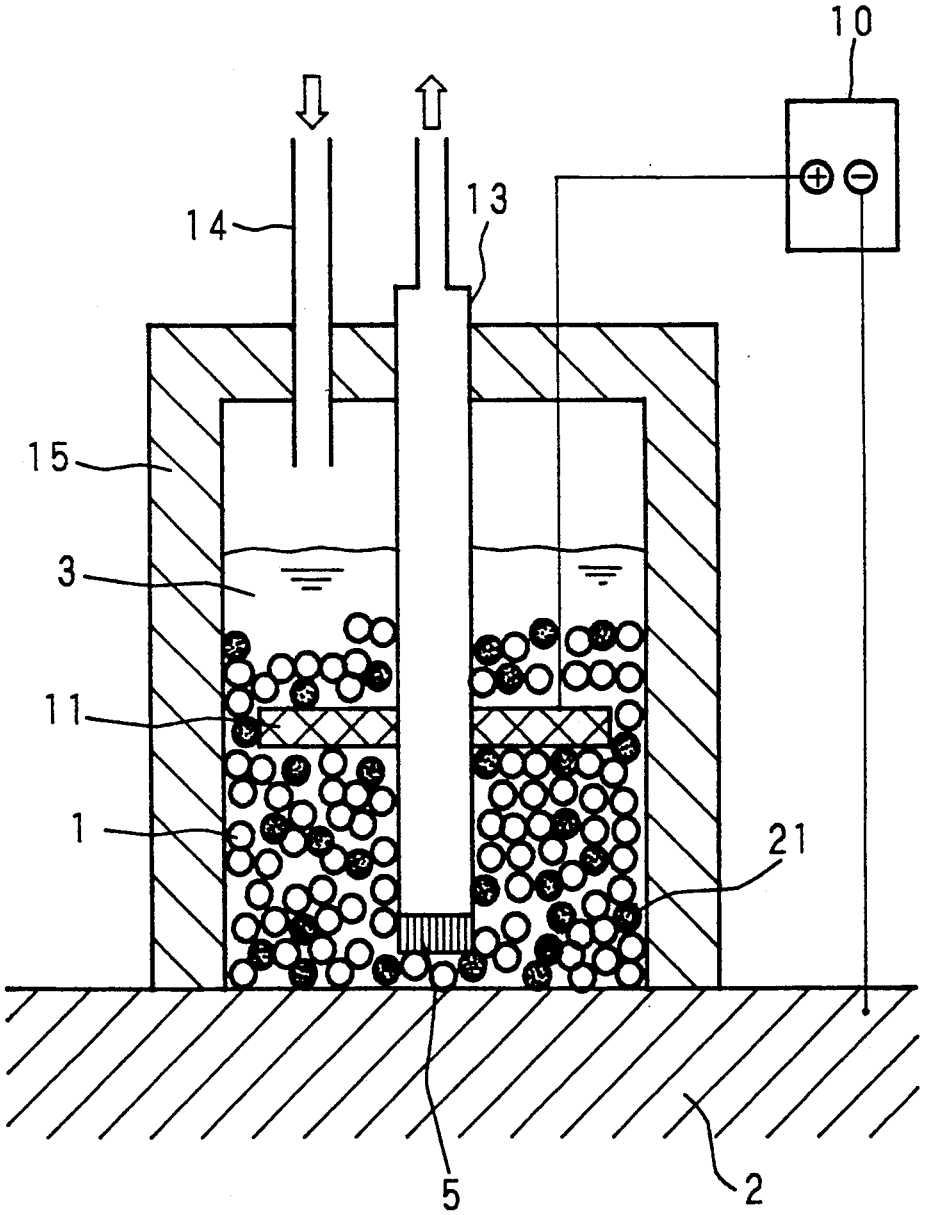
FIG. 17 is a sectional view showing the conduct state of a modified pattern of the third embodiment.
Figure 18:
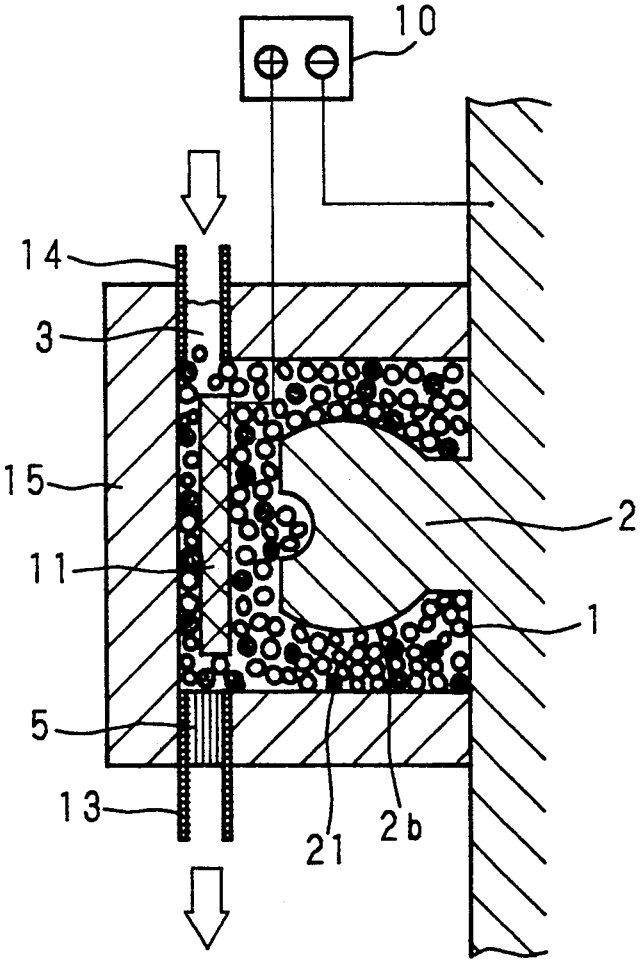
FIG. 18 is a sectional view showing the conduct state of another modified pattern of the third embodiment.

FIG. 17 shows a preferred embodiment of the invention in which dispersion plating is made on an object to be plated 2 holding a flat surface to be plated. In case of conducting dispersion plating over a wide area of surface, a separating member 15 is moved while section to be plated is moved. FIG. 18 shows a preferred embodiment of the invention in which dispersion plating is made on an object to be plated 2 holding a complicated curving surface 2b to be plated. In both cases, the same mechanism and process as those of the preferred embodiment of the invention mentioned above are used. Accordingly, no description is made here about the mechanism and process of this preferred embodiment of the invention.

In each preferred embodiment of the invention, description is made about the case of electro plating as a typical adhering method of abrasive grains 1. However, it is also recommended to use electroless plating method using electroless plating liquid.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. A dispersion plating method for making first grains of a size larger than 10 μm adhere to an object to be plated, comprising:

a step of bringing simultaneously both said first grains and second grains different from said first grains into contact with the surface of said object to be plated;

a step of bringing plating liquid into contact with the surface of said object to be plated with which both said first and second grains come to contact; and a step of removing said second grains on the surface of said object to be plated.

2. A dispersion plating method according to claim 1, wherein both said first grains and second grains are put in an area separated by a separating member and both said first and second grains are brought into contact with the surface of said object to be plated simultaneously in said area.

3. A dispersion plating method according to claim 1, wherein said first grains are abrasive grains.

4. A dispersion plating method according to claim 3, wherein said abrasive grains are diamond grains whereas said second grains are glass bead grains.

5. A dispersion plating method according to claim 1, wherein said plating liquid contains nickel ions.

6. A dispersion plating method according to claim 1, further comprising:

a pre-plating step of conducting a strike plating on the surface of said object to be plated prior to the processing.

* * * * *